US005121920A

United States Patent [19]

Laezzo et al.

[11] Patent Number: 5,121,920

[45] Date of Patent: Jun. 16, 1992

[54] AIR DRIVEN RANDOM BALL TYPE LOT MIXER

[76] Inventors: Patrick D. Laezzo; Craig P. Laezzo, both of 110 Soundview Ave., Huntington, Conn. 06484

[21] Appl. No.: 562,207

[22] Filed: Aug. 3, 1990

[51] Int. Cl.[5] ..... A63F 3/06

[52] U.S. Cl. ..... 273/144 B; 273/144 A

[58] Field of Search ..... 273/1 L, 269, 138 R, 273/138 A, 144 R, 144 A, 144 B

[56] References Cited

U.S. PATENT DOCUMENTS

| | | | |
|---|---|---|---|
| 2,315,323 | 3/1943 | Fostos | 273/144 A |
| 2,385,980 | 10/1945 | Fostos | 273/144 |
| 3,044,780 | 7/1962 | Silverman | 273/144 |
| 3,468,542 | 9/1969 | Ernst | 273/144 |
| 4,583,736 | 4/1986 | Lorraine | 273/144 B |
| 4,601,471 | 7/1986 | Frank | 273/144 |
| 4,786,056 | 11/1988 | Dunnigan | 273/144 |
| 4,895,370 | 1/1990 | Kline | 273/144 |
| 4,961,578 | 10/1990 | Chateau | 273/144 B |

FOREIGN PATENT DOCUMENTS

| | | | |
|---|---|---|---|
| WO8400115 | 1/1984 | Int'l Pat. Institute . | |
| 0649003 | 2/1979 | U.S.S.R. | 273/144 A |
| 1061166 | 12/1983 | U.S.S.R. | 273/144 B |

OTHER PUBLICATIONS

"Maryland State Lottery Video Tape" shows machine made by Gyron Plastics of Baltimore as of 1972.

*Primary Examiner*—Edward M. Coven
*Assistant Examiner*—William M. Pierce
*Attorney, Agent, or Firm*—Ailes, Ohlandt & Greeley

[57] ABSTRACT

A random number generator comprising a housing with a mixing chamber, an air chamber, and an air distribution plate disposed between the mixing chamber and the air chamber. A plurality of numbered balls are disposed within the mixing chamber. An upflow air means for providing an upflow air stream is disposed within the air chamber and is capable of mixing and propelling the balls upward within the mixing chamber. A plurality of ball collection columns are attached to the housing, preferably near the top of the housing. Each ball collection column comprises a vacuum-creating means for withdrawing at least one of the balls from the mixing chamber into the ball collection column and a retaining means for retaining the ball within the ball collection column; whereby a combination of numbered balls may be collected within the ball collection columns so as to provide a random list of numbers.

11 Claims, 4 Drawing Sheets

AIR DRIVEN RANDOM BALL TYPE LOT MIXER

The present invention relates generally to a mechanical random number generator which is capable of easily selecting a combination of random numbered balls which may be used in lottery or bingo games.

BACKGROUND OF INVENTION

Many games of chance are based upon the occurrence of random events in a fixed universe of possible random events. These games typically involve the prediction by an individual that a desired set of random events such as the occurrence of a certain set of random numbers out of a larger but fixed universe of possible random numbers will result from the game. Public interest in this form of amusement has progressed from local bingo games and fairs to the adoption of government-run lotteries in many states. All these games require a device which most nearly creates a truly statistically random selection of events.

These games of chance also require the players to choose their own number or combination of numbers. Players typically use various mathematical formulas or special numbers associated with birthdays, anniversaries and other meaningful dates. However, arriving at the desired combination of numbers either every week or biweekly is extremely difficult and time consuming. If the player desires to play various number combinations to increase his or her chance of winning, then the number selection process becomes even more tedious.

There are various complex and expensive random number generator devices currently available for adaptation to lottery or bingo games. Most of these devices are sold to the game authorities and due to their expense are not available to the players. Some examples are set forth in U.S. Pat. No. 4,786,056 (Dunnigan), which issued Nov. 22, 1988, U.S. Pat. No. 2,315,323 (Fostos), which issued Mar. 30, 1943, U.S. Pat. No. 2,385,980 (Fostos), which issued Oct. 2, 1945, and U.S. Pat. No. 4,583,736 (Lorraine), which issued Apr. 22, 1986. All of the aforementioned devices are air actuated and require intricate mechanical means for selecting and retaining randomly selected balls.

U.S. Pat. No. 4,583,736 (Lorraine) provides an adaptor hood which sits on a downsized, bingo-ball blower. The hood includes a lower access hole to receive lightweight numbered balls from an underlying blower chamber in which the balls are blown about; a spring-biased selector arm that normally straddles and blocks the hole, but which can be manually pivoted to allow a ball to pop up the hole and which can then be released to spring back and kick the ball away during its return movement; an adjacent inclined ramp that receives the kicked ball to feed it downwardly; and a clear display chute that catches the balls from the ramp and allows them to be viewed by a user.

U.S. Pat. No. 4,786,056 discloses a random number generator assembly which includes a mixing chamber, a blower, a multi-planar ramp made of expanded metal serves to increase the mixing effect of the balls providing more complete and rapid randomization; and a storage means.

Other less complicated devices for random number selection are set forth in U.S. Pat. No. 4,895,370 (Kline), which issued Jan. 23, 1990, U.S. Pat. No. 4,601,471 (Frank), which issued Jul. 22, 1986, and U.S. Pat. No. 3,044,780 (Silverman), which issued Jul. 17, 1962; Russian Patent Nos. 649,003 (Mariiskpoly), which issued Feb. 1979, and 1,061,166 (Pochekaev), which issued Dec. 1983; and International Patent Application No. 84/00115 (Rundgren), which was published on Jan. 19, 1984.

U.S. Pat. No. 4,601,471 (Frank) discloses a random number generating device for randomly selecting one of a plurality of suspendable balls which are stirred and circulated in a chamber by an upflowing fluid stream. Upon termination of fluid flow one of the balls falls downwardly through a relatively narrow bottom trough into a lower pocket having a transparent wall.

U.S. Pat. No. 4,895,370 (Kline) discloses a random number selection device wherein a hollow spherically-shaped container is rotated. Within the container there is provided a plurality of balls. Coupled to the container is a ball distributor having a sliding actuator with a plurality of partitions integrally formed thereon to define queuing spaces therebetween. The ball distributor is connected to a ball receiving chamber for selection of numbered balls.

Most of the aforementioned patents are directed to either single ball or complicated multiple ball selection devices. Other patents describe conventional non-air actuated ball selection devices.

The present invention is an attempt to provide an inexpensive and easy to use multiple ball selection device. This device does not require complicated mechanical instruments to select random balls in order to obtain a combination of random numbers and can be manufactured inexpensively. Further, the balls are selected from a single mixing chamber which avoids the use and cost of multiple mixing chambers. This device also overcomes the clogging problems associated with many of the conventional single ball outlet air actuated ball selection machines.

The present invention also provides a device which can rapidly select a combination of random numbered balls, return the selected balls to the mixing chamber, and repeat the selection procedure. This device is suitable for use at home or at lottery ticket sales offices. It aids in the selection of a set of random numbers which can be used to play a lottery game, and its rapid ball selection and release mechanisms allow for faster decision making by players at the lottery ticket sales office. Increasing the speed with which a player selects his or her numbers is particularly desirable when jackpots reach record amounts and the number of players increase proportionately.

Additionally, the present invention is capable of rapidly adjusting the number of ball collection columns to conform to the amount of numbers required in any particular lottery game. This is extremely helpful to players who engage in the playing of various lottery games or to lottery ticket sales offices which carry multiple games.

This random number generator is extremely inexpensive and may be purchased by individual players for selecting numbers at their respective homes and thereby avoid the inherent pressure of selecting numbers at the lottery ticket sales office. The design of the device also allows players to develop their own games requiring selection of random numbers. That is, this device can operated such that only one numbered ball is selected or a plurality of balls are selected depending upon the requirements of the game or players.

Additional advantages of the present invention shall become apparent as described below.

SUMMARY OF THE INVENTION

A random number generator comprising a housing with a mixing chamber, an air chamber, and an air distribution plate disposed between the mixing chamber and the air chamber. A plurality of numbered balls are disposed within the mixing chamber. An upflow air means for providing an upflow air stream is disposed within the air chamber and is capable of mixing and propelling the balls upward within the mixing chamber. A plurality of ball collection columns are attached to the housing, preferably near the top of the housing. Each ball collection column comprises a vacuum-creating means for withdrawing at least one of the balls from the mixing chamber into the ball collection column and a retaining means for retaining the ball within the ball collection column; whereby a combination of numbered balls may be collected within the ball collection columns so as to provide a random list of numbers.

An additional object of the present invention is a random number generator comprising a plurality of ball collection columns affixed to a removable plate which is attached to the housing. The removable plate is slideably attached to the housing so that the number of ball collection columns may be easily changed depending upon the amount of random numbers required for a specific game. The removable plate is secured to the housing by means of a pair of parallel guide means. Preferably an airtight seal is provided between the removeable plate and the parallel guide means.

Other and further objects, advantages and features of the present invention will be understood by reference to the following specification in conjunction with the annexed drawings, wherein like parts have been given like numbers.

DESCRIPTION OF THE PREFERRED EMBODIMENTS

Generally, the present invention relates to a numbered ball selecting game capable of developing random number combinations which are useful in playing various government-run lotteries and any other games requiring random number selection. The numbered balls are circulated within a housing by means of upflowing air and directed into selected ball collection columns by opening the top of the designated column so as to cause a ball to move into the column due to the force of the upflowing air and the vacuum created by the opening of the column. Thus, various number combinations may be obtained by systematically opening and closing each column. The upflowing air and vacuum forces individual balls to move into each column as its respective cap is removed. The balls are retained in each column by a retaining means and stoppers positioned near the outlet of each column. Once the ball is securely retained within the column by the associated retaining means and stoppers, then the column is re-capped. Thereafter, the caps of the other columns are removed one at a time in a similar fashion until a numbered ball is disposed within each column. If a new combination of numbers is desired, then the upflowing air and retaining means are removed such that the balls within the columns return to the housing where they are mixed with the other balls and the selection process is repeated.

Figure 1:
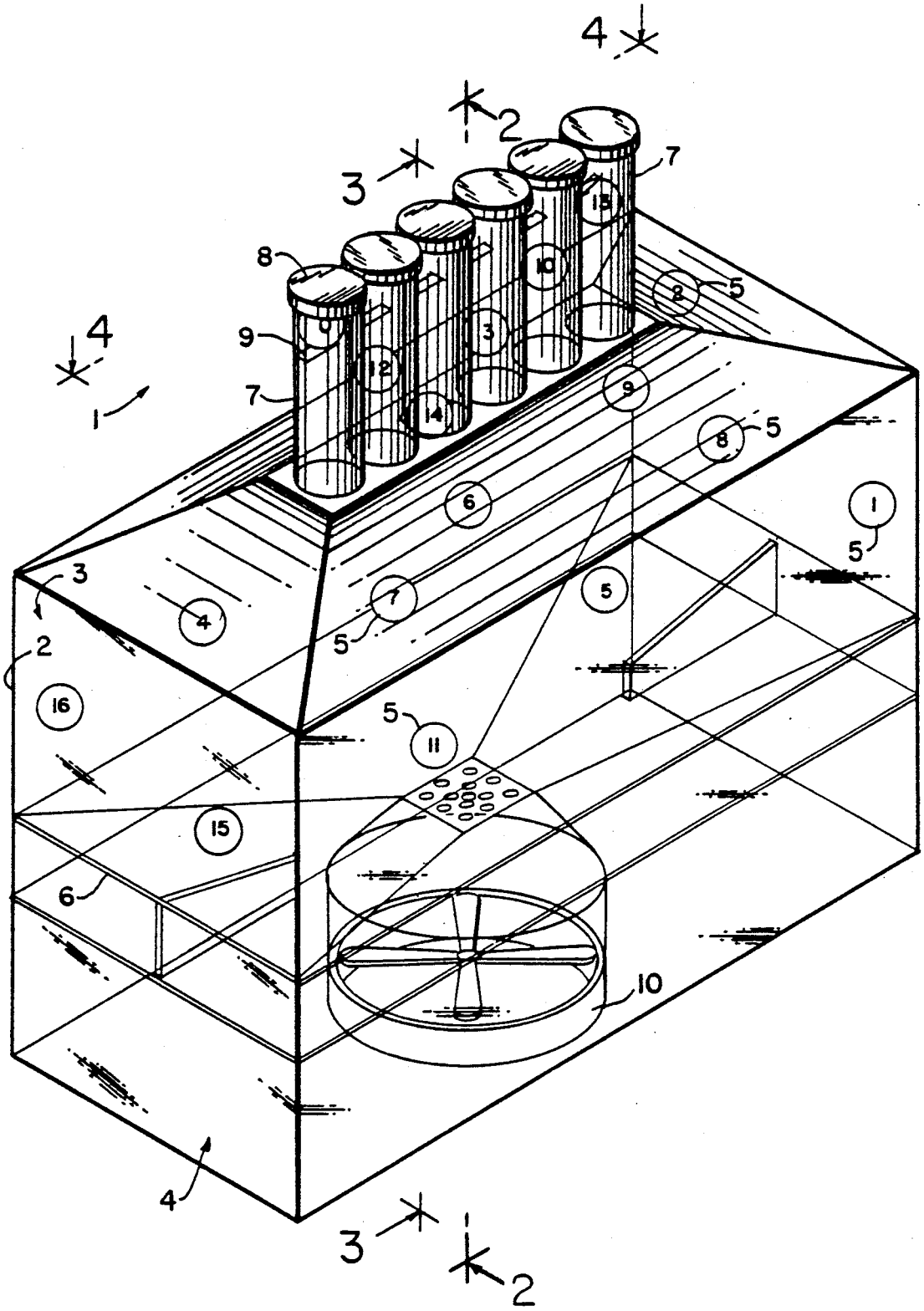
FIG. 1 is a top-front-side perspective view of a random number generator in accordance with the present invention.
Figure 2:
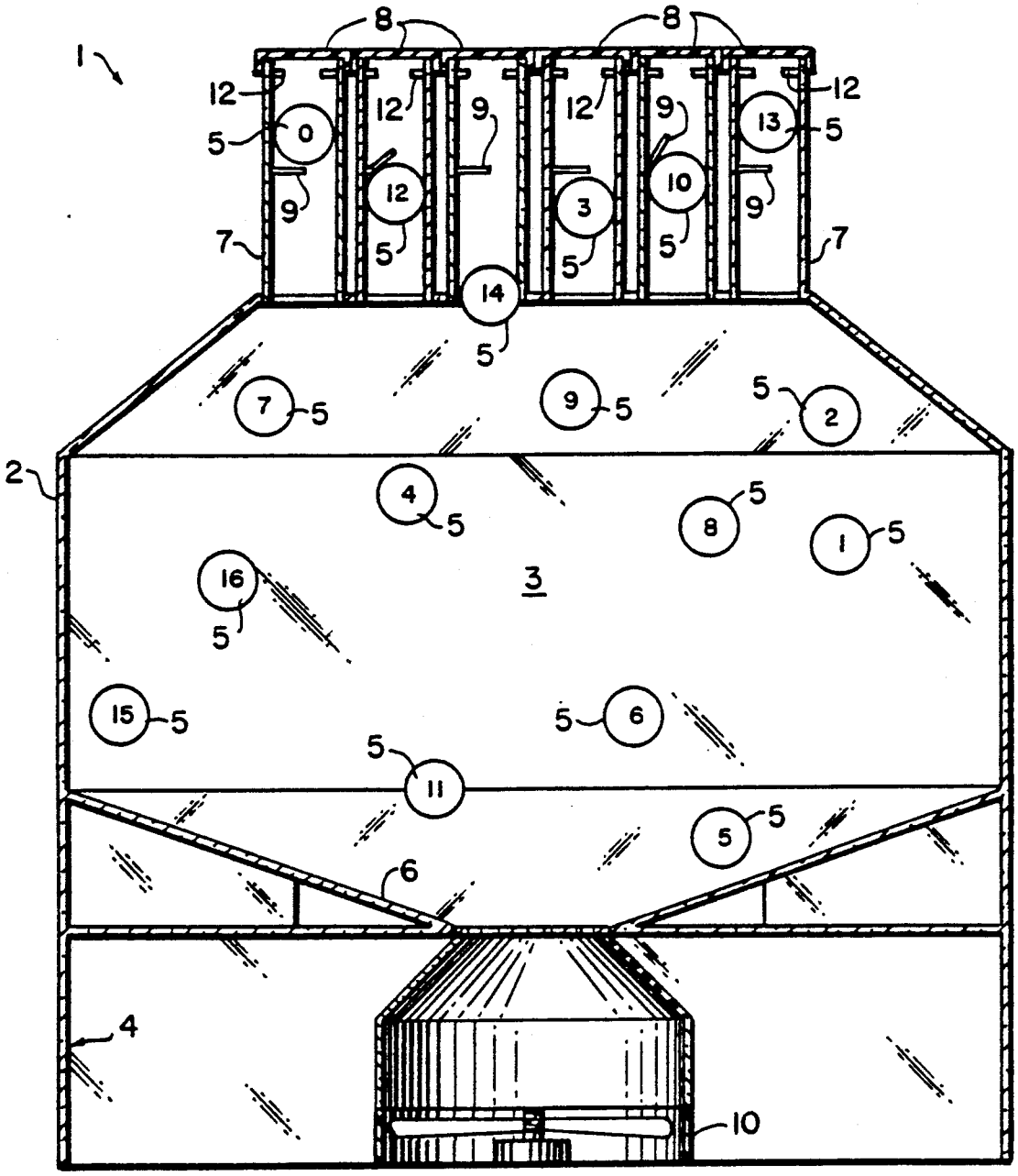
FIG. 2 is a cross-sectional view of FIG. 1 across line 2—2.
Figure 3:
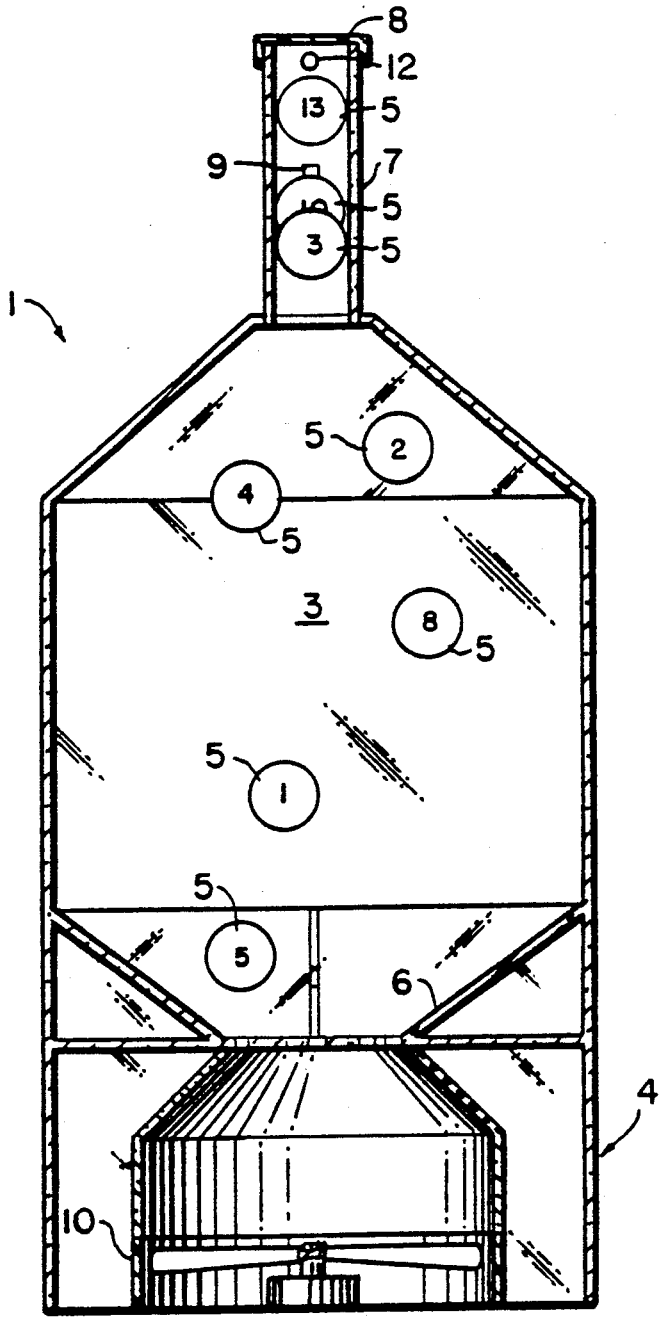
FIG. 3 is a side view of a random number generator in accordance with the present invention.
Figure 4:
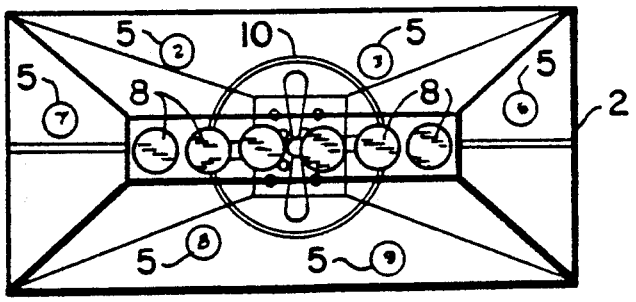
FIG. 4 is a top planar view of a random number generator in accordance with the present invention.

Referring to the drawings in detail, the preferred embodiment of a random number generator is shown in FIG. 1. FIG. 1 depicts a random number generator 1 which includes a housing 2 with a mixing chamber 3 and an air chamber 4. A plurality of numbered balls 5 are disposed within mixing chamber 3. An air distribution plate 6 is disposed between mixing chamber 3 and air chamber 4. An upflow air means 10 is disposed within air chamber 4 for providing an upflow air stream which is capable of mixing and propelling balls 5 upward within mixing chamber 3. A plurality of ball collection columns 7 are attached near the top of housing 2, and each ball collection column 7 includes a vacuum-creating means 8 capable of withdrawing at least one of balls 5 from mixing chamber 3 into ball collection column 7 and a retaining means 9 for retaining balls 5 within ball collection column 7; whereby a combination of numbered balls 5 may be collected within ball collection columns 7 so as to provide a random list of numbers.

The operation of random number generator 1 can best be described while referring to FIGS. 1, 2, 3 and 4. A plurality of different numbered balls 5 are disposed within a mixing chamber 3 of housing 2. Upflowing air is generated from an upflow air means 10 and passes from air chamber 4 into mixing chamber 3 via an air distribution plate 6. The upflowing air mixes and propels balls 5 upward. Each ball collection column 7 is operated independently from the others. When the player is ready to select his or her numbers the vacuum-creating means 8 for withdrawing a ball 5 from mixing chamber 3 into a column 7 is activated. Vacuum-creating means 8 is typically a removeable cap which is disposed about the outlet of column 7 in an airtight manner. Upon the removal of cap 8 from column 7, a random ball 5 passes into column 7 due to the force of the upflowing air and the vacuum created by the removal of cap 8. The upward movement of ball 5 within column 7 is restricted by stoppers 12 and its downward movement is restricted by retainer means 9. Once a ball 5 is safely retained within column 7, the cap is replaced and the cap on the next column is removed in order to select another numbered ball 5 in the same manner as described above.

Once each column 7 contains a ball 5 the number selection process is complete and the player may record the combination of randomly selected numbers. If the player would like to play again or obtain a different combination of numbers, the upflowing air means 10 is turned off and retaining means 9 are removed such that the retained balls 5 are releases and returned to mixing chamber 3. The above ball selection procedures are then repeated to obtain a new combination of numbers.

Random number generator 1 is preferably formed from a clear PLEXIGLAS (a registered trademark) material so that players may observe the mixing and random selection of balls 5. In order to enhance the mixing of balls 5, air distribution plate 6 is tapered such that it slopes downward in the direction of the air holes which are preferably positioned within the center of plate 6. The ceiling of housing 2 is preferably formed by an upper tapered plate so as to enhance mixing and aid in the directing of balls 5 into columns 7. Columns 7 are typically attached to a substantially horizontal portion of the upper tapered plate of housing 2.

Upflow air means 10 for providing an upflow air stream is any known fan device. Alternatively, the upflow air stream may also be created by attaching an ordinary household hair dryer to air chamber 4. Upflow air means 10 is disposed within air chamber 3 and positioned directly beneath the air holes of air distribution plate 6.

Retaining means 9 is capable of retaining balls 5 within ball collection columns 7 and preventing their return to mixing chamber 3. Retaining means 9 are either removeable pins or hinged tabs which permit balls 5 to move into a ball holding portion of ball collection columns 7, but does not permit the ball to return to mixing chamber 3 until released.

Figure 5:
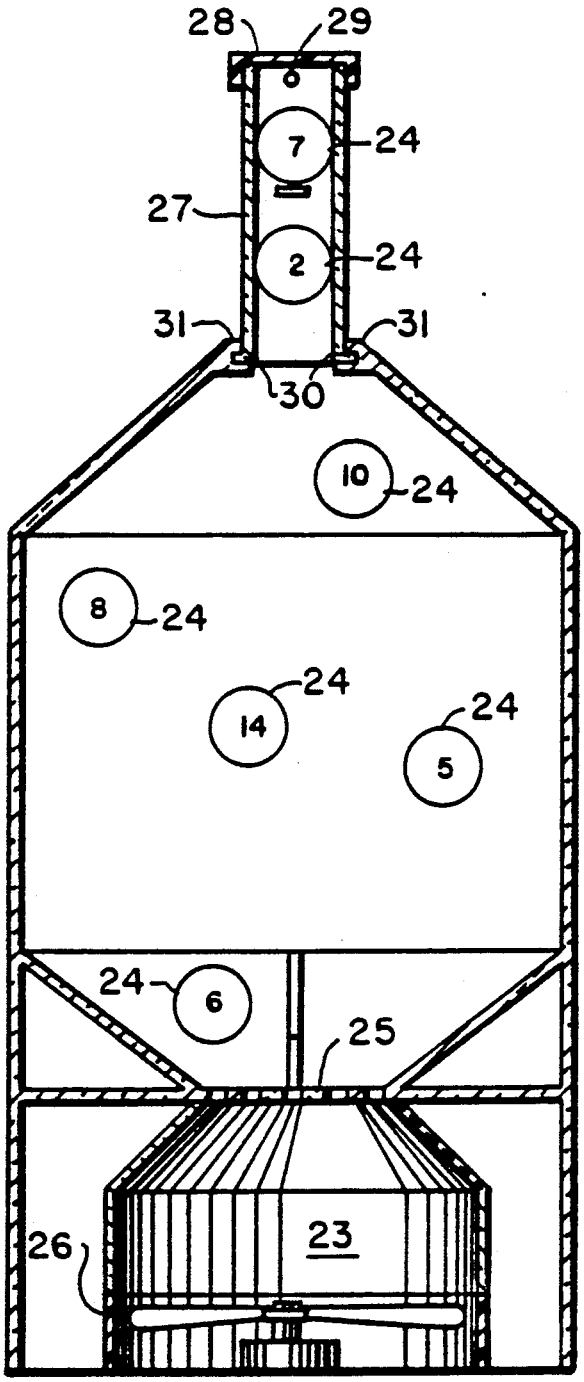
FIG. 5 is a side view of another embodiment of the random number generator in accordance with the present invention wherein the ball collection columns are attached to a removeable plate which is replaceably mounted onto the housing via guide means.

FIG. 5 depicts another embodiment of the present invention wherein the number of ball collection columns 27 may be readily changed to reflect the amount required in a specific game, e.g., a six number lottery or seven number lottery. Random number generator 20 includes a housing 21 with a mixing chamber 22 and an air chamber 23. A plurality of numbered balls 24 are disposed within mixing chamber 22. An air distribution plate 25 is disposed between mixing chamber 22 and air chamber 23. An upflow air means 26 for providing an upflow air stream is disposed within air chamber 23, and is capable of mixing and propelling balls 24 upward within mixing chamber 22. A plurality of ball collection columns 27 affixed to removeable plate 30 are attached to housing 21, and each ball collection column 27 includes a vacuum-creating means 28 for withdrawing at least one of balls 24 from mixing chamber 22 into ball collection column 27 and a retaining means 29 for retaining balls 24 within ball collection column 27; whereby a combination of numbered balls 24 may be collected within ball collection columns 27 so as to provide a random list of numbers.

Removable plate 30 can have any reasonable number of ball collection columns 27 affixed thereto so as to provide a random number generator 20 capable accommodating games which require a different amount of numbers. In this regard, a player can use one machine for various games simply by replacing a removable plate 30 with another removable plate 30 having the desired amount of ball collection columns 27 affixed thereto. Removable plate 30 is preferably slideably attached to housing 21 wherein the amount of ball collection columns 27 may be easily changed depending upon the amount of random numbers required for a specific game. Removable plate 30 is secured to housing 21 by means of a pair of parallel guide means 31. It is desirable that an airtight seal be provided between removeable plate 30 and parallel guide means 31 in order to insure proper functioning of the device. Removable plate 30 may be affixed to housing 21 by any other means known to those possessing ordinary skill in the art.

While we have shown and described several embodiments in accordance with our invention, it is to be clearly understood that the same are susceptible to numerous changes apparent to one skilled in the art. Therefore, we do not wish to be limited to the details shown and described but intend to show all changes and modifications which come within the scope of the appended claims.

What is claimed is:

1. A random number generator comprising:

a housing which comprising a single mixing chamber, an air chamber, an air distribution plate disposed between said mixing chamber and said air chamber, and a ceiling formed by an upper vertically tapered plate;

a plurality of numbered balls disposed within said mixing chamber;

a means for providing an upflow air stream disposed within said air chamber which is capable of mixing and propelling said balls upward within said mixing chamber; and a plurality of ball collection columns attached to said ceiling of said housing adjacent to, but not disposed within, said mixing chamber, each ball collection column comprising a means for withdrawing at least one of said balls from said mixing chamber into said ball collection column and a means for retaining said ball within said ball collection column; whereby a combination of numbered balls from said mixing chamber may be collected within said ball collection columns so as to provide a random list of numbers and whereby the balls do not get trapped between the ceiling of said housing and said ball collection columns.

2. The random number generator according to claim 1 wherein said air distribution plate is vertically tapered to permit complete mixing of the plurality of numbered balls within said mixing chamber.

3. The random number generator according to claim 2 wherein said air distribution plate includes air holes substantially near the center thereof.

4. The random number generator according to claim 1 wherein said means for providing an upflow air stream is a fan.

5. The random number generator according to claim 1 wherein said means for providing an upflow air stream is positioned beneath said air distribution plate.

6. The random number generator according to claim 1 wherein said means for withdrawing at least one of said balls into said ball collection column is a removeable cap.

7. The random number generator according to claim 1 wherein said means for retaining said ball within said ball collection column is a removeable pin.

8. The random number generator according to claim 1 wherein said means for retaining said ball within said ball collection column is a hinged tab which permits said ball to move into said ball collection column, but does not permit said ball to return to said mixing chamber until released.

9. The random number generator according to claim 1 wherein said ball collection column also comprises a means for restricting the upward movement of said balls.

10. The random number generator according to claim 9 wherein said means for restricting the upward movement of said balls is a pair of stoppers.

11. A random number generator comprising:

a housing which comprising a single mixing chamber, an air chamber, an air distribution plate disposed between said mixing chamber and said air chamber, and a ceiling formed by an upper vertically tapered plate;

a plurality of numbered balls disposed within said mixing chamber;

a means for providing an upflow air stream disposed within said air chamber which is capable of mixing and propelling said balls upward within said mixing chamber; and a plurality of ball collection columns affixed to a removable plate which is slideably attached to the ceiling of said housing by means of a pair of parallel guide means and are adjacent to, but not disposed within, said mixing chamber, each ball collection column comprising a means for withdrawing at least one of said balls from said mixing chamber into said ball collection column and a means for retaining said ball within said ball collection column; whereby a combination of numbered balls from said mixing chamber may be collected within said ball collection columns so as to provide a random list of numbers and whereby the balls do not get trapped between the ceiling of said housing and said ball collection columns.

* * * * *